US005425410A

United States Patent [19]

Reynolds

[11] Patent Number: 5,425,410

[45] Date of Patent: Jun. 20, 1995

[54] SAND CASTING MOLD RISER/SPRUE SLEEVE

[75] Inventor: Mark W. Reynolds, Arthur, Canada

[73] Assignee: Pyrotek, Inc., Spokane, Wash.

[21] Appl. No.: 296,349

[22] Filed: Aug. 25, 1994

[51] Int. Cl.[6] ..... B22C 9/02; B22C 9/08

[52] U.S. Cl. ..... 164/358; 164/134; 164/359; 164/362

[58] Field of Search ..... 164/358, 362, 359, 360, 164/134; 210/483

[56] References Cited

U.S. PATENT DOCUMENTS

| | | | |
|---|---|---|---|
| 1,030,066 | 6/1912 | Erlandson | 164/358 |
| 4,154,289 | 5/1979 | Jeanneret | 164/358 |
| 4,798,615 | 1/1989 | Fukuta et al. | 164/358 X |
| 4,928,746 | 5/1990 | Butler et al. | 164/362 |

FOREIGN PATENT DOCUMENTS

| | | | |
|---|---|---|---|
| 2647381 | 11/1990 | France | 164/358 |
| 46-25149 | 7/1971 | Japan | 164/358 |
| 61-293647 | 12/1986 | Japan | 164/134 |
| 63-224837 | 9/1988 | Japan | 164/358 |

*Primary Examiner*—J. Reed Batten, Jr.
*Attorney, Agent, or Firm*—Wells, St. John, Roberts, Gregory & Matkin

[57] ABSTRACT

The sprue/riser sleeve 40 has a tubular, preferably cylindrical wall 42 extending between an inlet end 48 and an outlet end 50. The sleeve 40 has a woven mesh filter extending across a central passageway 51 with a periphery 54 of the filter 52 embedded into the wall 42. The periphery 54 has three or more, evenly spaced tabs 56 formed thereon that project further into or through the wall to secure the filter to the wall without materially weakening the wall. Preferably, the filter has a square-shaped periphery 54 with corners 64 that define the tabs 56. The main portion of the periphery extends into the wall less that one-half the thickness of the wall, whereas the tabs extend into the wall a distance greater than one-half the thickness.

13 Claims, 4 Drawing Sheets

SAND CASTING MOLD RISER/SPRUE SLEEVE

TECHNICAL FIELD

This invention relates to sand casting mold riser/-sprue sleeves for facilitating the pouring of molten metal into a sand casting mold cavity.

BACKGROUND OF THE INVENTION

FIG. 1 illustrates a sand casting mold for casting metal parts. The sand casting mold is generally identified with the numeral 10. The illustrated mold 10 is formed in two complementary parts forming a mold cavity 12. The cavity 12 is surrounded by mold sand 14. Molten metal is poured into the cavity 12 through a mold sprue 16. One or more risers 18 are provided to permit air to escape from the cavity while the cavity is being filled and to provide a reservoir for molten metal while the metal in the cavity is cooling and contracting.

Refractory insular sleeves 20 are provided at the sprue 16 and riser 18 to protect the sand and to prevent sand from being carried into the cavity as the molten metal is being poured.

Considerable effort has been expended to develop insular riser/sprue sleeves that not only perform the traditional function of facilitating the pouring and uniform filling of a sand cast mold cavity with molten metal, but also filters the molten metal to remove foreign particles as the molten metal is being poured without materially hindering the flow of the molten metal into the mold cavity.

Several attempts have been made to construct such sleeves having filter systems mounted within the sleeves themselves. One such sleeve is commercially available under the brand name "Dypur" from Foseco, International Ltd. of Birmingham, England. It is generally described in U.S. Pat. No. 4,928,746 (Butler et. al.). The "Dupur" sleeve utilizes a rigid porous ceramic foam disc separately mounted to the interior wall of the insular sleeve to filter the molten metal as the metal flows through the sleeve into the sand cast cavity. Shoulder or wedge structures are utilized to rigidly secure the disc filter to the interior wall to minimize the possibility of the disc filter being dislodged and passing with the molten metal into the mold cavity, thereby ruining the casting.

Although the "Dupur" sleeve has met with some commercial success, it is rather expensive and has other disadvantages. Attempts have been made to place a less expensive circular flexible refractory mesh filter within an insular sleeve to perform the filtering function as well as providing a weakened fracture plane to facilitate the removal of the resulting metal sprue or riser after the molten metal has solidified.

One such prior attempt is illustrated in FIGS. 2–4. The sleeve 20 has a tubular wall 22 with outer and inner surfaces 24, 26 extending from an inlet end 28 to a reduced diameter (necked down) outlet end 30 (closest to the cavity 12). A refractory woven mesh filter 32 is mounted in the necked down outlet end 30. The filter 32 has a circular periphery 34 that projects into wall 22 more than one-half the thickness of the wall 20 at the outlet end 30. Such a penetration by the filter 32 materially weakens the strength of the wall 22 facilitating wall fracture. However, if the periphery of the mesh filter does not extend a sufficient distance into the wall, the filter is not adequately supported and the filter has a tendency to become partially or wholly dislodged from the wall and rendered ineffective.

One of the principal objects and advantages of the present invention is to provide an inexpensive sprue/-riser sleeve having a woven mesh filter that does not materially weaken the sleeve wall while at the same time is unlikely to become partially or wholly dislodged from the wall from the combined head and flow pressure exerted by the molten metal as it passes though the sleeve into the mold cavity.

These and other objects and advantages of this invention will become apparent upon reviewing the attached drawing and following description of preferred and alternate embodiments.

BRIEF DESCRIPTION OF THE DRAWINGS

Preferred embodiments of the invention are described below with reference to the accompanying drawings, which are briefly described below.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
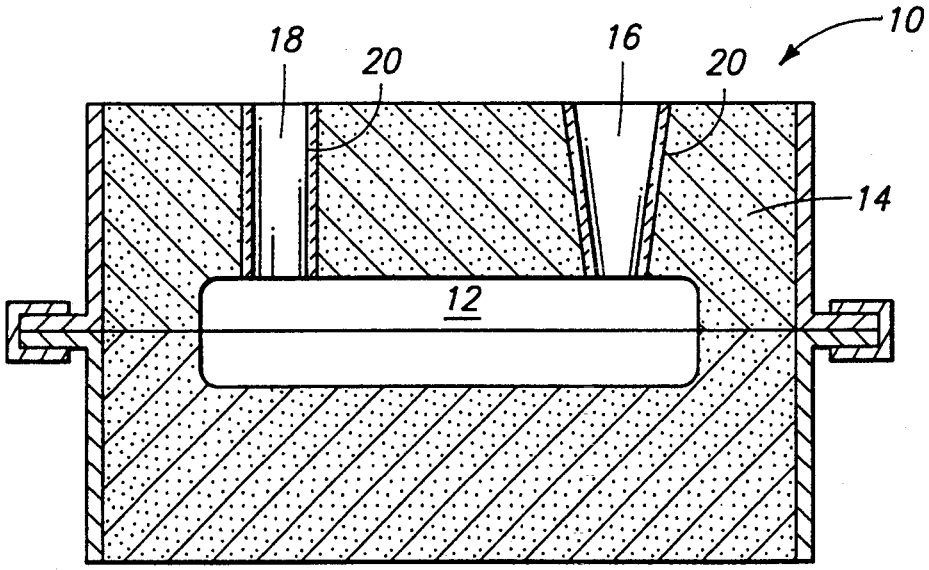
FIG 1 PRIOR ART
FIG. 1 is a diagrammatical vertical cross-section of a typical sand casting mold illustrating the presence and location of sprue/riser sleeves.
Figure 2:
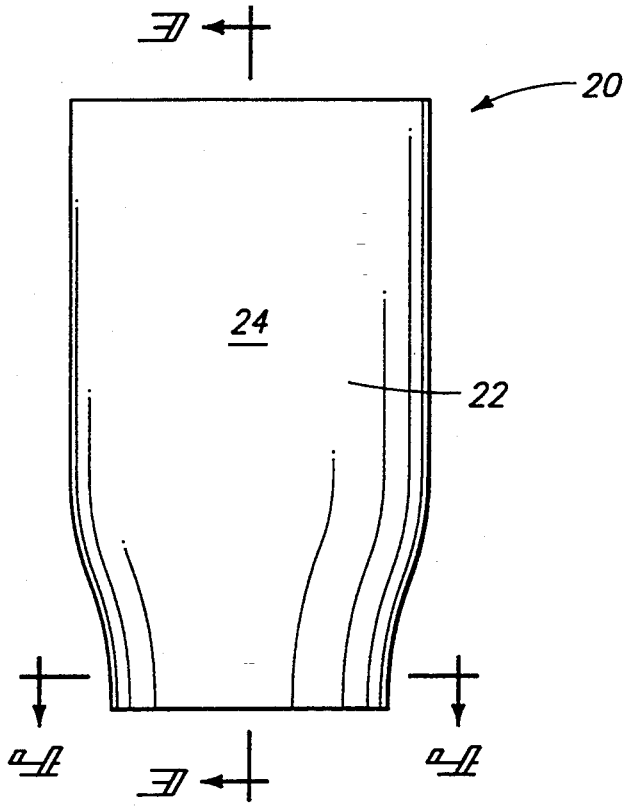
FIG 2 PRIOR ART
FIG. 2 is a front view of a prior art sprue/riser sleeve.
Figure 3:
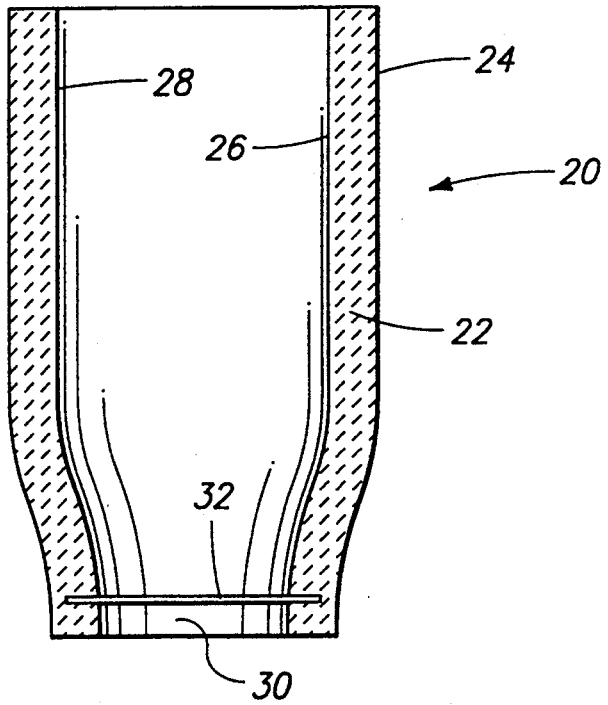
FIG 3 PRIOR ART
FIG. 3 is a vertical cross section view taken along line 3—3 in FIG. 2.
Figure 4:
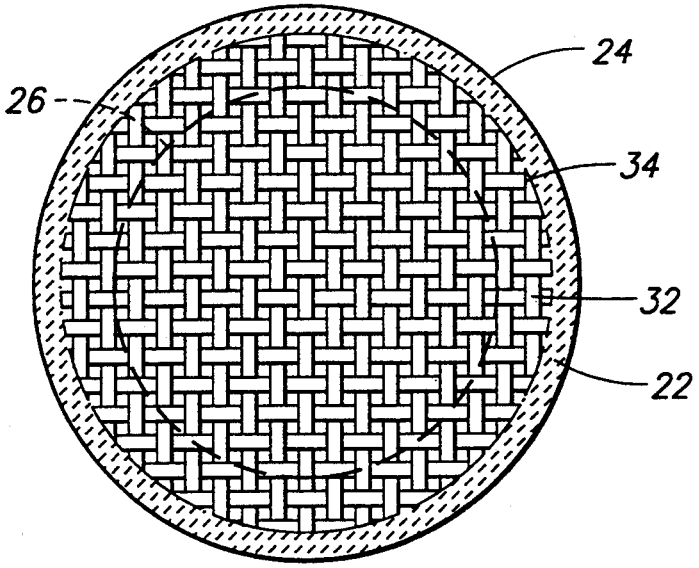
FIG 4 PRIOR ART
FIG. 4 is a horizontal cross sectional view taken along line 4—4 in FIG. 2.
Figure 5:
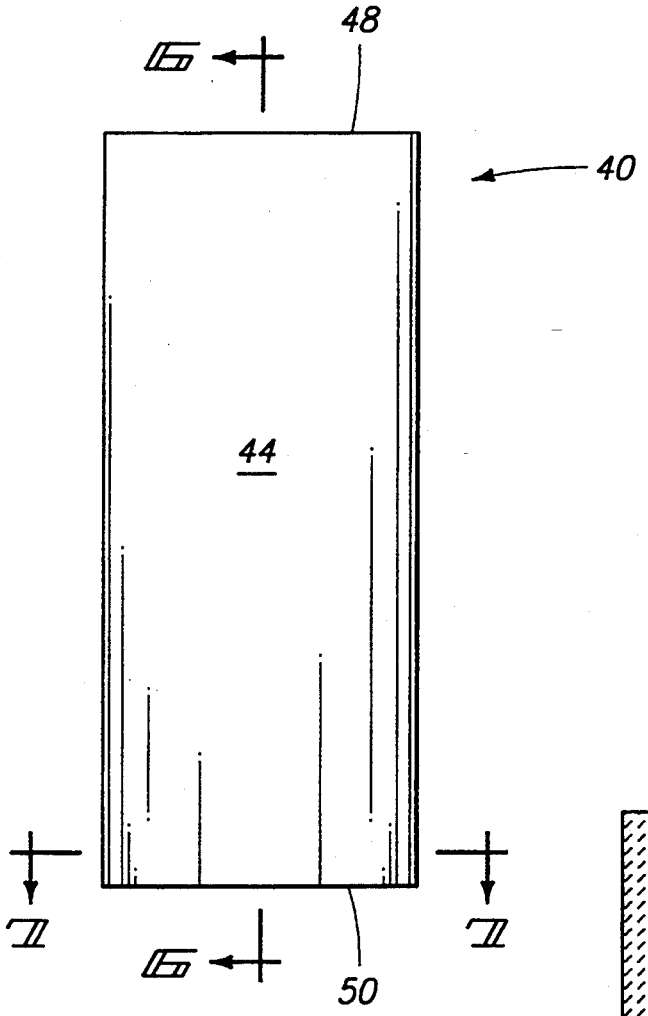
FIG. 5 is a front view of a preferred embodiment of the present invention.
Figure 6:
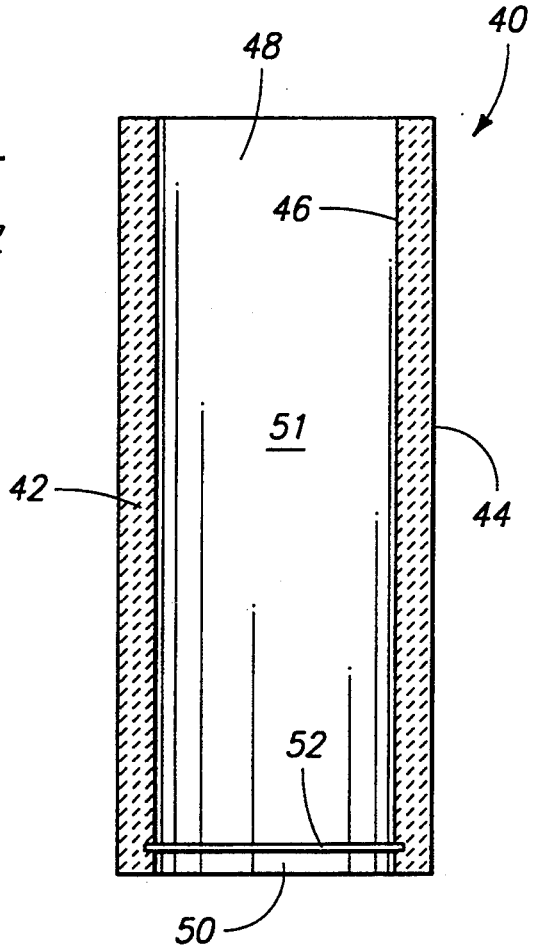
FIG. 6 is a vertical cross sectional view taken along line 6—6 in FIG. 5.
Figure 7:
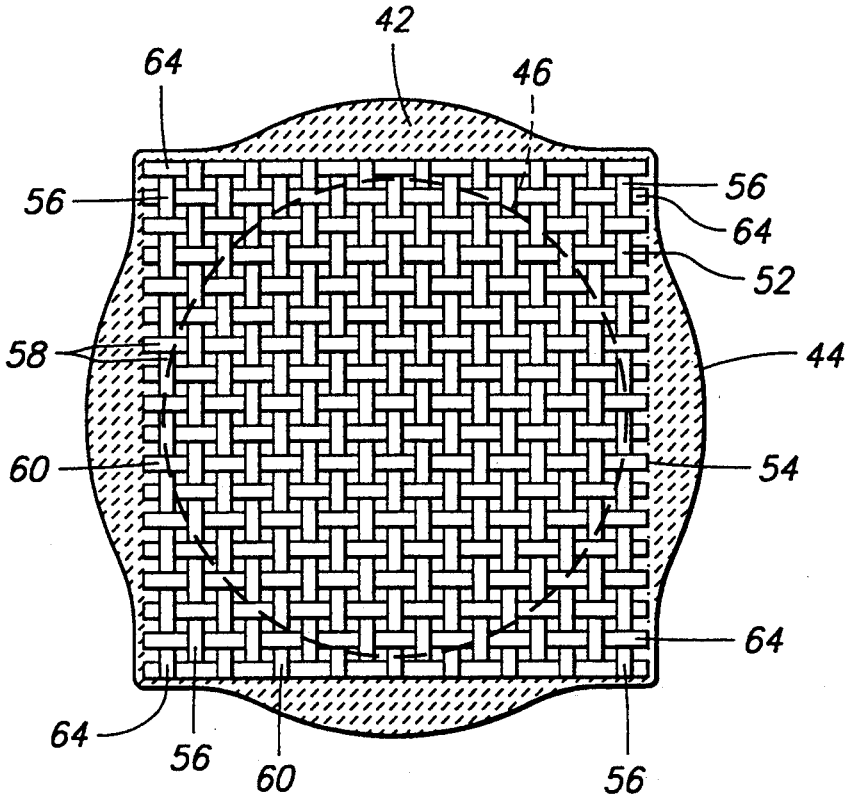
FIG. 7 is a horizontal cross sectional view taken along line 7—7 in FIG. 5.

A preferred embodiment of the present invention is illustrated in FIGS. 4–7 comprising a sand casting sprue/riser sleeve 40. The sleeve 40 has a tubular, substantially cylindrical wall 42 with an outer surface 44 and an inner surface 46 extending from an inlet end 48 to an outlet end 50 about a central passageway 51. Preferably, the central passageway 51 has rather uniform prescribed diameter along its length.

Generally the sleeve 40 is formed on the exterior of a porous mandrel. The mandrel is placed in a slurry of refractory ceramic fibers and colloidal silica binder. A vacuum is applied to the mandrel to cause the refractory ceramic fibers and colloidal silica binder to build up on the mandrel until a desired wall thickness is obtained.

Generally the inner surface 46 is rather smooth and the outer surface 44 is rather uneven. In one embodiment the central passageway 51 has a diameter of 3.0 inches and the wall 42 has a thickness of approximately one-half inch.

The sleeve 40 has a refractory woven flexible mesh filter 52 transversely mounted across the central passageway 51 with a mesh periphery 54 embedded in the wall 42 adjacent the outlet end 50. The filter 52 has three or more tabs 56, preferably evenly spaced about the periphery 54, that are embedded into the wall 42 to secure the woven mesh filter to the wall 42 to prevent the filter 52 from becoming partially or wholly dislodged when subjected to the combined head and flow pressure of the molten metal as it flows through the sleeve 40. Additionally the tabs 56 do not materially weaken the strength of the wall 42.

The woven mesh is preferably formed of woven flexible fiberglass threads 58 with ends 60 being exposed to increase the frictional gripping between the threads and the wall material. During the sleeve forming process the periphery 54 including the tabs 56 extend radially outward from the mandrel into the slurry enabling the wall material to build up on and between the spaces of the mesh.

Preferably, the woven mesh filter 52 has a square-shaped periphery 54 in which the side or minimum surface dimension is greater than the inner diameter of the wall 42 but less than the outer diameter of the wall 42. The square-shaped filter 52 has corners 64 that define four, evenly spaced tabs 56. Preferably, the diagonal dimension of the filter 52 is substantially equal to or greater than the outer diameter of the wall 42. In one example, the interior diameter of the wall is 3.0 inches and the outer diameter of the wall 42 is 4.0 inches (wall thickness is 0.5 inches). The square-shaped filter 52 has a side dimension of 3.25 inches and a diagonal dimension of 4.3 inches. Consequently the filter at its minimum dimension extends into the wall a distance of 0.125 inches and at its maximum dimension extends through the wall 42 at the four corners forming the securing tabs 56. In this example, the wall 42 is only weakened at the corners 64 and retains substantial strength and integrity midway between the corners.

Alternatively, the filter may have a star shaped periphery with the star points serving as tabs 56. Or the filter 52 may have a spur gear shaped periphery with the gear teeth serving as tabs 56. In each case, the amount of the wall cross section penetrated by the woven mesh filter is minimized to maintain the wall integrity and strength, while at evenly spaced locations projections (tabs 56) are provided that extend deeper into or through the wall to provide additional support. It should be noted that the tabs 56 are formed of the same woven mesh material as the main body of the filter 52. Further, it should be noted that circumferential distance about the periphery 54 is greatly increased in comparison to the circumferential distance of a prior art circular periphery 34. In the above example the circumferential distance is approximately 30 percent greater, further increasing the ability of the wall to support the filter 52 without materially weakening the strength of the wall 42.

Preferably, the main portion of the periphery 54 extends into the wall less that one-half the thickness of the wall, whereas the tabs 56 extend into the wall a distance greater than one-half the thickness.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A sand casting mold riser/sprue sleeve, comprising:

a refractory body having an elongated, substantially tubular wall with interior and exterior wall surfaces extending between an inlet end and an outlet end about a central passageway;

a woven flexible mesh filter extending transversely across the central passageway adjacent the outlet end in which the filter has a periphery embedded in the refractory wall; and said mesh filter having at least three mounting tabs formed about the periphery projecting into the body wall toward the outer wall surface to frictionally secure the mesh filter to the tubular body to prevent the mesh filter from being dislodged from the refractory body as molten metal flows through the central passageway.

2. The sand casting mold riser/sprue sleeve as defined in claim 1 wherein the mesh filter has a non-circular periphery.

3. The sand casting mold riser/sprue sleeve as defined in claim 1 wherein the mounting tabs are formed about the periphery at angularly spaced locations.

4. The sand casting mold riser/sprue sleeve as defined in claim 3 wherein the mounting tabs are formed about the periphery at evenly spaced angular locations.

5. The sand casting mold riser/sprue sleeve as defined in claim 1 wherein the mesh filter is rectangular shaped having corners that define the mounting tabs.

6. The sand casting mold riser/sprue sleeve as defined in claim 1 wherein the mesh filter is square-shaped having corners that define the mounting tabs.

7. The sand casting mold riser/sprue sleeve as defined in claim 1 wherein the woven mesh filter has refractory threads with exposed ends that extend outward at the filter periphery that are embedded into tubular wall.

8. The sand casting mold riser/sprue sleeve as defined in claim 1 wherein the inner wall surface has an inner diameter and the outer wall surface has an outer diameter and wherein the mesh filter is rectangular shaped having corners that define the mounting tabs in which the rectangular shaped mesh filter has a minimum width dimension that is greater than the inner diameter and a maximum diagonal dimension substantially corresponding to the outer diameter.

9. The sand casting mold riser/sprue sleeve as defined in claim 1 wherein the tubular wall has a prescribed thickness wherein the tabs project into the wall a distance greater than on-half the wall thickness and wherein the periphery of the mesh filter between the tabs projects into the tubular wall a distance less than one-fourth the wall thickness to secure the mesh filter securely to the wall without materially weakening the strength of the wall.

10. The sand casting mold riser/sprue sleeve as defined in claim 9 wherein the tabs project into the wall a distance substantially equal to the wall thickness.

11. The sand casting mold riser/sprue sleeve as defined in claim 9 wherein the tabs are evenly spaced about the periphery of the mesh filter.

12. The sand casting mold riser/sprue sleeve as defined in claim 1 wherein the tubular wall is formed with the periphery of the mesh filter embedded therein.

13. The sand casting mold riser/sprue sleeve as defined in claim 1 wherein the tubular wall is formed from a slurry of refractory ceramic fibers and refractory colloidal silica with the mesh filter imbedded therein adjacent the outlet end as the tubular wall is being formed.

* * * * *